United States Patent [19]

Dills

[11] Patent Number: 4,478,048

[45] Date of Patent: Oct. 23, 1984

[54] AIR SENSING CONTROL SYSTEM FOR AIR CONDITIONERS

[75] Inventor: Raymond L. Dills, Louisville, Ky.

[73] Assignee: General Electric Company, Louisville, Ky.

[21] Appl. No.: 586,051

[22] Filed: Mar. 5, 1984

[51] Int. Cl.[3] ..... F24F 7/00; F25B 49/00

[52] U.S. Cl. ..... 62/126; 62/179; 165/16; 236/49

[58] Field of Search ..... 236/49, 44 R; 165/16, 165/21; 62/179, 126, 411

[56] References Cited

U.S. PATENT DOCUMENTS

| | | | |
|---|---|---|---|
| 2,858,678 | 11/1958 | Rose | 62/267 |
| 3,360,801 | 11/1982 | Duhame | 340/521 |
| 3,860,919 | 1/1975 | Aker | 340/237 R |
| 3,950,155 | 4/1976 | Komiyama | 55/210 |
| 3,957,200 | 5/1976 | Young | 236/44 R |
| 4,058,253 | 11/1977 | Munk et al. | 236/49 R |
| 4,088,986 | 5/1978 | Boucher | 340/237 S |
| 4,150,370 | 4/1979 | Bradshaw | 340/518 |
| 4,164,172 | 8/1979 | Anderten et al. | 165/16 X |
| 4,295,028 | 10/1981 | Tanabe | 219/10.55 B |
| 4,299,554 | 11/1981 | Williams | 431/16 |
| 4,311,895 | 1/1982 | Tanabe | 219/10.55 B |
| 4,316,068 | 2/1982 | Tanabe | 219/10.55 B |
| 4,324,966 | 4/1982 | Tanabe | 219/10.55 B |
| 4,335,379 | 6/1982 | Martin | 340/634 |
| 4,338,526 | 7/1982 | Martin et al. | 307/116 |
| 4,340,885 | 7/1982 | Chavis et al. | 340/632 |
| 4,352,321 | 10/1982 | Fukoi et al. | 98/2.11 |
| 4,390,869 | 6/1983 | Christen et al. | 340/632 |

*Primary Examiner*—William E. Wayner

*Attorney, Agent, or Firm*—Frank P. Giacalone; Radford M. Reams

[57] ABSTRACT

A unitary air conditioner unit adapted to be mounted through a wall opening of an enclosure to be conditioned including an air sensing system operative for generating a signal dependent on the level of gases in the enclosure air. The control is operable for adding outside air to the circulating enclosure air or for exhausting enclosure air when a first level of gases sensed and for causing an alarm to sound when the level of gases is above a predetermined value.

4 Claims, 4 Drawing Figures

UNIT OFF
UNIT ON
CLOSE AIR DAMPERS STOP FAN
IS SENSOR SET
102
NO
YES
SET COMFORT LEVEL AND SENSING MOTE
104
IS STOP REQUIRED ?
126
YES
NO
DAMPER VENT AIR A. D. J.
106
SMOKE ALARM
124
IS SENSOR OPERATIONAL ?
108
NO
YES
SENSOR OPERATIONAL
110
IS THRESHOLD EXCEEDED ?
122
ADJUST AIR FLOW IN/OUT
112
IS SMOKE HEAVY ?
120
YES
NO
IS SMOKE LITE ?
118
YES
YES
IS SMOKE DETECTED ?
116
NO
IS ROOM AIR OK ?
114
YES
ROOM AIR ACCEPTABLE

AIR SENSING CONTROL SYSTEM FOR AIR CONDITIONERS

BACKGROUND OF THE INVENTION

The invention relates to air conditioning systems in general and particularly to an air conditioner including means for sensing the presence of hydrocarbon gases and humidity in the air being circulated within the enclosure being air conditioned. The sensing means generates electrical signals having values indicative of the concentration of gases and humidity sensed. The invention includes vent means operable by the sensing means for exhausting enclosure air when the level of hydrocarbon gases exceeds a predetermined level and for activating an audible signal when the level of hydrocarbon gases exceeds a predetermined level. The sensing means further modulates the vent means to introduce exterior air into the circulating interior air in response to level of humidity sensed relative to a pre-selected level of humidity.

Conventional air conditioners include a filter which absorbs dust particles, some gases and other impurities in the air being recirculated. In situations where the development of high concentration of impurities occurs, for instance in the event of a fire, the provision of the filter is of limited benefit if at all since the air-purifying capability of the filter is far below what may be required to counteract the prevailing concentration of impurities. This danger is particularly present, of course, when the impurities are odorless and invisible, for instance carbon monoxide. Even when the impurities are detectable by the occupants of a room, such detectability is largely without meaning if the occupants are asleep.

SUMMARY OF THE INVENTION

It is an object of the present invention to provide a sensing system for an air conditioner which overcomes the dangers of the development of concentrations of impurities greater than the corrective capability of the system, unbeknownst to the occupants of the room in which the system is provided.

By the present invention the unitary air conditioning unit, includes a housing, a partition within the housing dividing it into interior and exterior chambers. Arranged in the exterior chamber is an outdoor heat exchanger and fan means for circulating exterior air through the external chamber. Arranged in the interior chamber is an indoor heat exchanger and fan means for circulating interior air through the interior chamber. A vent opening is formed in the partition including a damper operable between a closed and open position for allowing an exchange of air between the chambers. An air sensing control system including gas humidity sensor is arranged for sensing recirculating interior air. The sensor is operative for generating electrical signals having values indicative of the level of humidity and of concentration of gases in the air contacting the sensor. In the presence of humidity the system controls the position of the damper and the directional rotation of the fan means for causing introduction of exterior air to the interior chamber for maintaining the humidity of the interior air at a selected value. In the event impurities are sensed the damper and the directional rotation of the fan means are set in an exhaust mode so that the interior air is exhausted independent of the humidity level. The control system further provides an audible and visible warning means operative for issuing a signal when the level of impurities sensed are above a predetermined amount. The audio signal is energized when the accumulative level of impurities exceeds the ability of the unit in the exhaust mode to effectively eliminate impurities. The control in carrying out the invention provides means for connecting the sensing means to the warning means, fan means and damper means, and for the operating the warning means, fan means and vent means dependent upon the value of the electrical signal generated by the sensing means.

DETAILED DESCRIPTION

Figure 1:
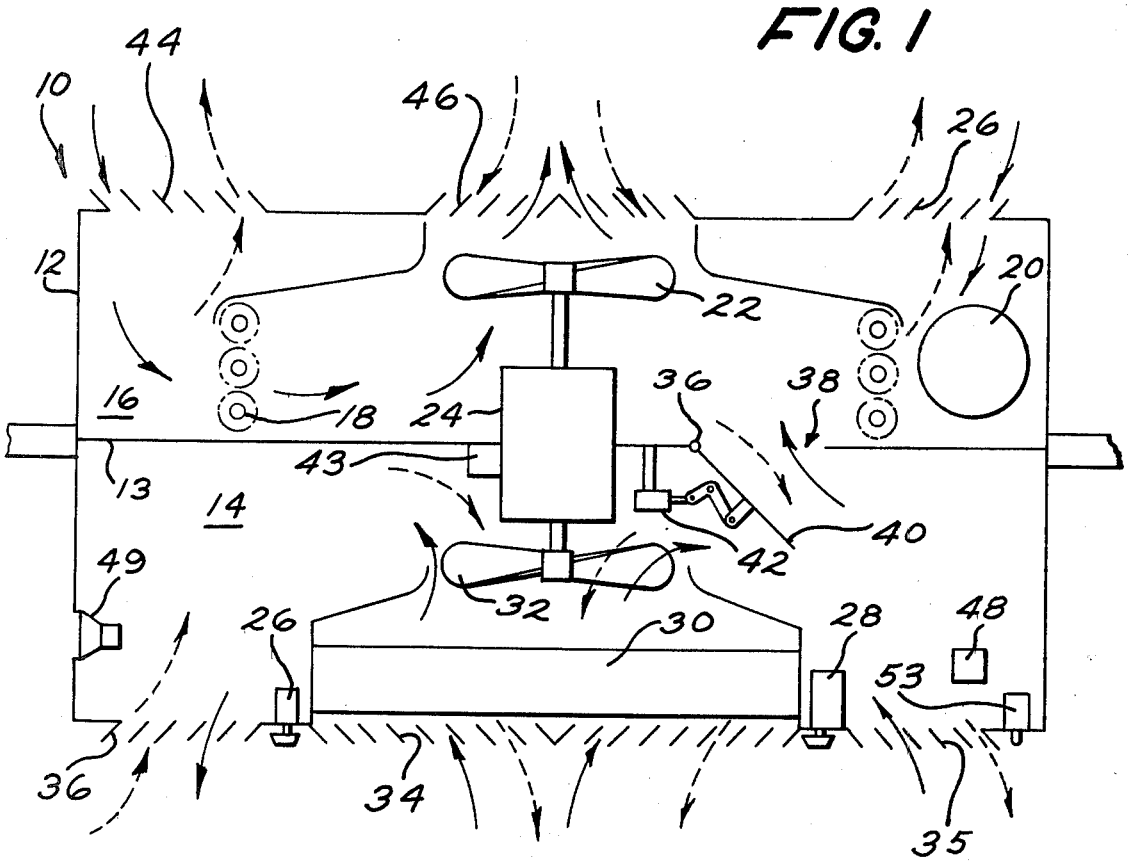
FIG. 1 is a schematic plan view of a unitary air conditioning unit incorporating the present invention.

Referring now to FIG. 1, there is shown diagramatically an air conditioning unit 10, including a housing 12 adapted to be mounted in a window or other aperature of a room or enclosure to be conditioned. The space within the housing 12 is divided by a barrier or partition 13 into two compartments or chambers designated the inner or evaporator chamber 14 and the outer or condenser chamber 16. Within the outer chamber 16 there is positioned the refrigeration system condenser 18, compressor 20 and a fan 22 driven by a reversible motor 24 mounted within the partition 13. Within the inner chamber 14 there is positioned the refrigeration system evaporator 30 and fan 32 also driven by the reversible motor 24.

Generally the air conditioning unit 10 is controlled by a thermostat 26 and a selector switch 28. The user sets the thermostat 26 at a temperature at which the room is to be maintained. The selector switch 28 may be used for several functions such as whether the fan will cycle on and off with the compressor or run continuously. The selector switch 28 may also be used to select whether venting or exhausting of room air is desirable. In the present instance during venting a portion of the outdoor air is directed to be mixed with recirculating indoor air while during exhausting a portion of the indoor air is directed to be mixed with the outdoor.

In the event the room air being conditioned contains an objectionable level of impurities it may be desirable to exhaust some of the air within the enclosure to the outside in which instance the exhaust mode is selected on swtich 28, or in order to maintain a desired level of humidity it may be desirable to vent or bring in fresh outside air to be mixed with the recirculating enclosure air in which instance the vent mode is selected on swtich 28. In order to provide for these functions there is provided in the partition 13 an aperature or vent 38 which permits the flow of air between the two separate chambers 14 and 16. The flow of air through vent 38 is controlled by a damper 40 which is hingedly mounted at 36 on the partition 13 so as to pivot between an open and closed position relative to the vent 38. The damper 40 is actuated by a solenoid 42 whose energization during the normal cooling operation of the unit is affected through the selector switch 28.

When it is necessary to exhaust or expell some interior air through vent 38 to the outside atmosphere, the selector switch 28 is placed on the exhaust mode. Through a control circuit of selector switch 28 (not shown) the solenoid 42 is energized to rotate the damper 40 about hinge 36 to its open position. To effect exhaust of interior air to the outdoors it is necessary to have air flow through vent 38 from the inner chamber to the outer chamber 16. Accordingly, in the exhaust mode the fan motor 24 is electrically connected through a reversing switch 43 so that in one rotational direction as indicated in FIG. 1 by solid line arrows fan 22 draws outside air into the chamber 16 through opening 44 and across condenser 18 and expells the air through opening 46. At the same time as indicated by solid line arrows fan 32 draws room air into chamber 14 through opening 34 across the evaporator 30 and expells it back through opening 35. In this air flow pattern the difference in air pressure between chambers 16 and 14 will cause a portion of the circulating interior air to flow from the inner chamber 14 through vent 38 to the outer chamber 16 to thereby mix with the circulating outdoor air to be exhausted to the outside atmosphere.

When it is necessary to vent interior air or direct a portion of the circulating outside air through vent 38 to mix with the circulating interior air, the selector switch 28 is placed on the vent mode. Through the control circuit of selector switch 28 the solenoid 42 is energized causing the damper 40 to rotate about hinge 36 to its open position. To effect venting it is necessary to have air flow through vent 38 from the outer chamber 16 to the inner chamber 14. Accordingly, in the vent mode the fan 22 is electrically connected through the reversing switch 43 so that the fan motor 24 in the other or normal rotational direction as indicated by broken line arrows in FIG. 1 the fan 22 draws outside air into the chamber 16 through opening 46, condenser 18 and expells the air through opening 44. At the same time as indicated by broken line arrows the fan 32 draws room air into chamber 14 through opening 35 across evaporator 30 and expells it through opening 34. In this air flow pattern the difference in air pressure between the chambers 16 and 14 will cause a portion of the circulating exterior or outside air to flow from the outer chamber 16 through vent 38 to the inner chamber 14 to thereby be mixed into the circulating interior air being conditioned.

As thus far described, however, the air conditioner with its separate compartments forms no part of the present invention and is intended only to be illustrative of the type of air conditioner to which the invention may be adapted. One such type air conditioner which provides a vent and exhaust mode is disclosed in U.S. Pat. No. 2,858,678—Rose, assigned to the General Electric Co., assignee of the present invention. As will now be fully explained, the invention deals with an air sensing control function incorporating means for sensing the level of humidity in the room air and the level of gas concentration and more particularly to a control system for generating electrical signals having values indicative of concentration of gases. The air sensing control system utilizes these signals to cause an exchange of indoor and outdoor air, and for sounding an alarm in the event the level of gases in the indoor circulating air exceeds a predetermined level.

Air recirculating through the room being conditioned contains a certain level of humidity and may also contain a certain level of smoke or gases. By the air sensing control system of the present invention, such gases in the circulating enclosure air and are removed by exhausting a portion of the recirculating enclosure air to the outdoor atmosphere. Also by the present control a drop in the level of humidity below a predetermined level in the circulating enclosure air will cause outside air which in most instances contain a higher level of humidity to be introduced into the circulating enclosure air. The means for sensing the concentration level of humidity and gases in the recirculating air is provided in the form of a gas sensor 48 disposed in the enclosure air flow path between the openings 34 and 35 in chamber 14. The sensor 48 in the illustrative embodiment is a gas sensor readily commercially available from Figaro Engineering, Inc., identifiable as Model TGS No. 186. This sensor is responsive to the cumulative concentration of water vapor and various organic gases. It should be noted that smoke is considered by the sensor as a kind of gas. Use of such a sensor in an air purifying system is known in the art. One example of such a control arrangement is described in U.S. Pat. No. 3,950,155, wherein in an air purifying system a warning device issues a warning signal when the concentration of impurities in the air contacting the sensor exceeds a predetermined value. Another application of such a sensor is disclosed in U.S. Pat. No. 4,299,554, wherein a gas detector is provided for sensing the presence of hydrocarbon containing gas in a vent and a damper operable in response to a gas-present signal. Generally this type of sensor is sensitive to gas, temperature, humidity, smoke and smell, however, it is not able to differentiate gases, temperature and humidity. The resistance of the Figaro sensor changes in response to the level of humidity and gases in the air passing across it. By the present control this rate of sensor resistance change is employed to provide a signal which alters the flow of air through the unit and for providing an alarm when the sensor resistance drops below a predetermined value.

In accordance with the present invention, the air circulating through the room is sampled by the sensor 48 and information regarding the concentration level of gases in the circulating enclosure air provided by sensor 48 is used to control the venting and exhaust function of the air conditioner and to actuate an alarm 49 to provide an audio signal when the concentration of gases exceeds a threshold level. It should be noted that a visible indicator as referenced by numeral 47 in FIG. 2 may be provided in place of alarm 49 or together therewith.

Figure 2:
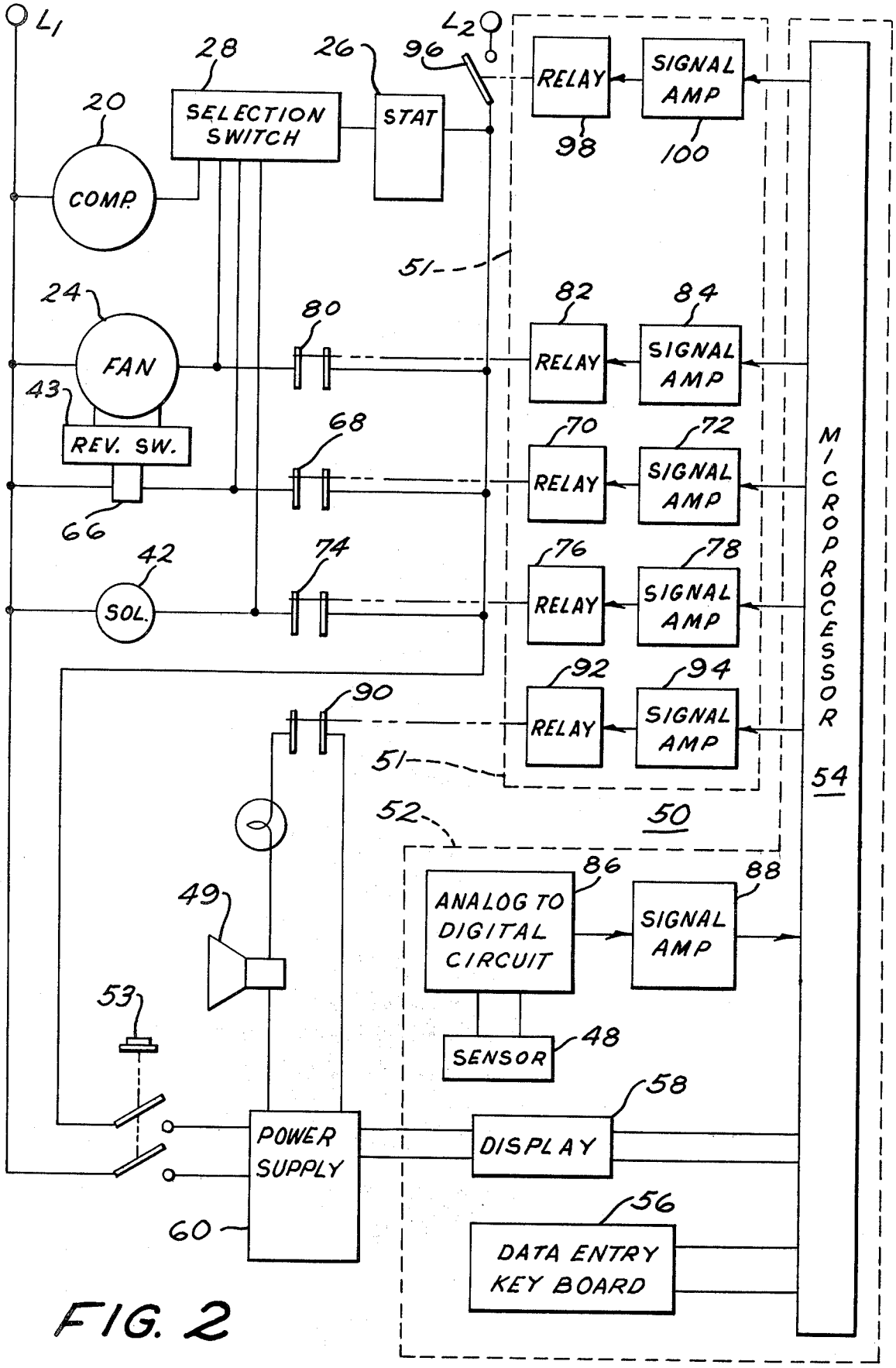
FIG. 2 is a functional block diagram and partial circuit of a control system constructed in accordance with the invention and employing a microprocessor as the decision means of the invention.

Referring now to FIG. 2, there is shown a simplified schematic diagram of the present control system. The gas sensor 48 is incorporated in a microprocessor based control arrangement 50 which carries out the function of the present invention. The circuit of FIG. 2 includes a power control portion 51 which includes the power output function, a signal processing portion 52 which includes the control input function and microprocessor 54, the data entry keyboard 56, the display 58, and the low voltage power supply 60. Electric power to the air sensing control system is provided from lines L1–L2 through a manually set air sensing function switch 53 arranged on the unit 10. The switch 53 is closed when the selection is made to use the enclosure air sensing function of the present invention.

The fan motor 24, compressor 20 and solenoid 42 have one terminal connected to power supply line L1 and a second terminal connected to power supply L2 via the selector switch 28 and thermostat 26 which is part of the air conditioning system control (not shown). The rotational direction of the fan 24 is controlled by the circuit of FIG. 2 through the reversing control switch 43 which includes a switching relay 66. Relay 66 during normal operation of the air conditioning unit is controlled through selector switch 28 and via a switch 68 of a control relay 70 in the power control portion 51 during the enclosure air sensing function of the present invention. The relay 70 is activated by an output signal from microprocessor 54 through a signal amplifier 72 located in the power control portion 50. The solenoid 42 is controlled through selector switch 28 during normal operation of the unit and via a switch 74 of a control relay 76 in power control portion 51 during the enclosure air sensing function of the present invention. The relay 76 is activated by an output signal from microprocessor 54 through a signal amplifier 78. The fan 24 is controlled through the selector switch 28 during normal operation of the unit and via a switch 80 of control relay 82 in the power control portion 51 during the air sensing function of the present invention. The relay 82 is activated through a signal amplifier 84. The alarm 49 is connected to the low voltage output of power supply 60. The alarm is controlled through a switch 90 of a control relay 92 in the power control portion 50. The relay 92 is activated by an output signal from microprocessor 54 through a signal amplifier 94 located in the power control portion 51.

Means are provided to shut down the unit under certain sensed conditions as will be explained later. To this end, located in line L2 is a switch 96 of a control relay 98 in power control portion 51. The relay 98 is activated by an output signal from microprocessor 54 through a signal amplifier 100.

The input signal to the signal processing portion 52 is received from the sensor 48. The sensor 48 has its output coupled through a suitable analog-to-digital conversion circuit 86 and a signal amplifier 88 to an input of microprocessor 54 to allow periodic sensing and storage of the level of humidity and gases present in the circulating room air.

Microprocessor 54 may comprise a self-contained integrated circuit such as a Motorola MC6805P2 including an arithmetic logic circuit, appropriate memory registers and input/output circuits as is well known in the art. Microprocessor 54, in part, is pre-programmed to be adapted to serve as a decision means for providing predetermined rotational operation of the fan 24 and operation of the solenoid 42 in a manner that will maintain humidity level in the recirculating room air at a selected level by providing venting of room air, and for causing room air to exhaust at a first level of gas concentration in the enclosure air and for causing the alarm 46 to give an audio signal at a second level of gas concentration in the enclosure air.

Figure 4:
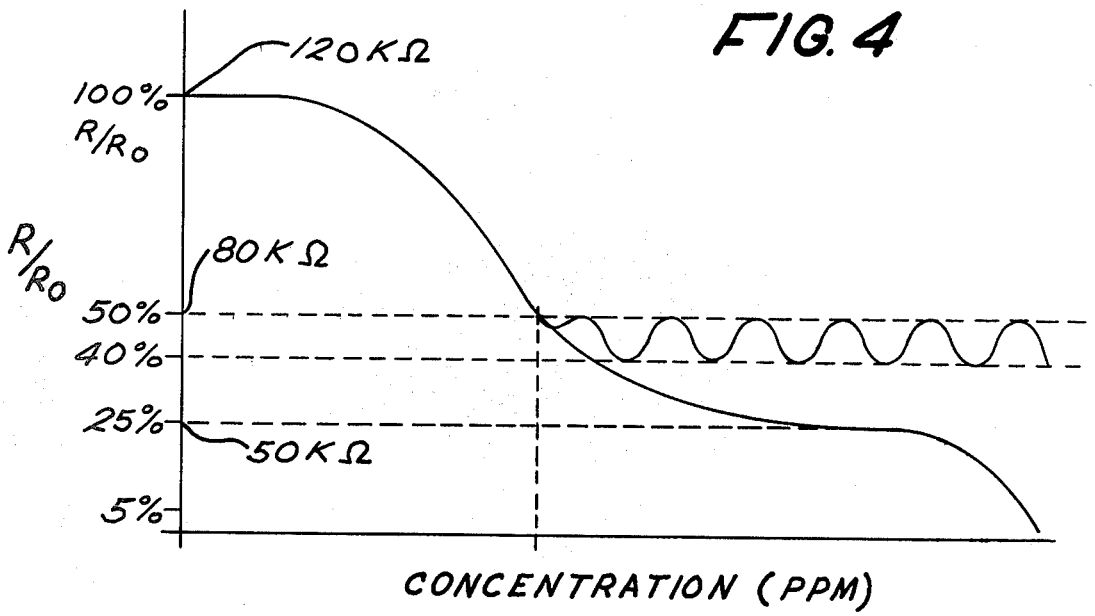
FIG. 4 depicts a curve representative of the gas sensing characteristic of the sensor employed in the present control.

The sensor resistance versus time curve of FIG. 4 shows the change in resistance of the sensing element of sensor 48 during operation of the room air conditioning unit in response to the changing concentration level of gases in the air circulating through the room. Assuming that when the air conditioner is initially turned on and the switch 53 is closed activating the air sensing control that there is an extremely low level of gas concentration and a relatively high humidity in the enclosure air. In this scenario the resistance of the sensor 48 would be relatively high at approximately 120KΩ. There next may ensue a period in which the resistance decreases indicative of a lowering of the level of humidity as the moisture in the recirculating air condenses on the evaporator. When the level of humidity drops below 50% the resistance drops to approximately 80KΩ. While as mentioned above the sensor cannot distinguish between humidity and gas concentration the control can be designed to produce an electrical signal at a predetermined sensor resistance. This 80KΩ resistance level is employed to produce a signal which will energize the solenoid 42, opening damper 40. At this time, the fan motor 24 is rotating in its normal direction. With the fan rotating in its normal direction and the damper open the unit in effect is operating in the vent mode, and accordingly a portion of the outside air is drawn through the opening 38 to be mixed with the recirculating room air as explained above. Since the outside air normally would have a higher concentration of moisture than the room air which is recirculated through the relatively cold evaporator its addition to the room air should tend to raise the level of humidity in the air. The solenoid 42 is then controlled to open and close the damper 40 to modulate the flow of outdoor air to maintain the room air at between 40% and 50% relative humidity with the resistance of sensor 48 fluctuating in the 80KΩ to 70KΩ.

The presence of impurities such as gases and smoke in the room air take precedence in that the resistance of the sensor 48 will drop rather quickly independent of the level of humidity as the level of gas concentration in enclosure air increases.

In the event of light concentration of gases or smoke, the resistance of the sensor 48 drops below 70KΩ. This lower resistance is used to generate a signal which activates the relay 70 which closes its switch 68. The closing of switch 68 activates the relay 66 of fan reversing switch 43. This in effect places the unit in the exhaust mode, and accordingly, room air is exhausted through vent 38 as explained above. Assume that with the unit operating in the exhaust mode the level of gas concentration drops. This will result in the resistance of sensor 40 to rise. If the resistance goes up to 70KΩ, the control will de-energize relay 70 and the unit will return to the vent mode and continue monitoring humidity. In the event the concentration of gas continues to increase while the unit is in the exhaust mode the resistance of the sensor element 48 will drop quickly to below 50KΩ. This sitation indicates that the level of impurities is greater than the corrective capability of the system and the unit should be shut down and the occupants warned. To this end the electrical signal of sensor 48 will carry out three actions. The first will cause the de-energization of relay 76 and through its switch 74 solenoid 42 closing off of vent 38. The second action will energize relay 92 closing its switch 90 which results in the activation of the alarm 49. The third action will cause relay 98 to be energized which opens switch 96 to shut down operation of the unit. The sounding of the alarm 49 indicates to the occupant of the room that a condition exists which requires the room to be evacuated and that the cause of the smoke be determined. In certain commercial installations such as office buildings or motels the system may include a means for alerting a central control that a situation exists requiring immediate attention.

Figure 3:
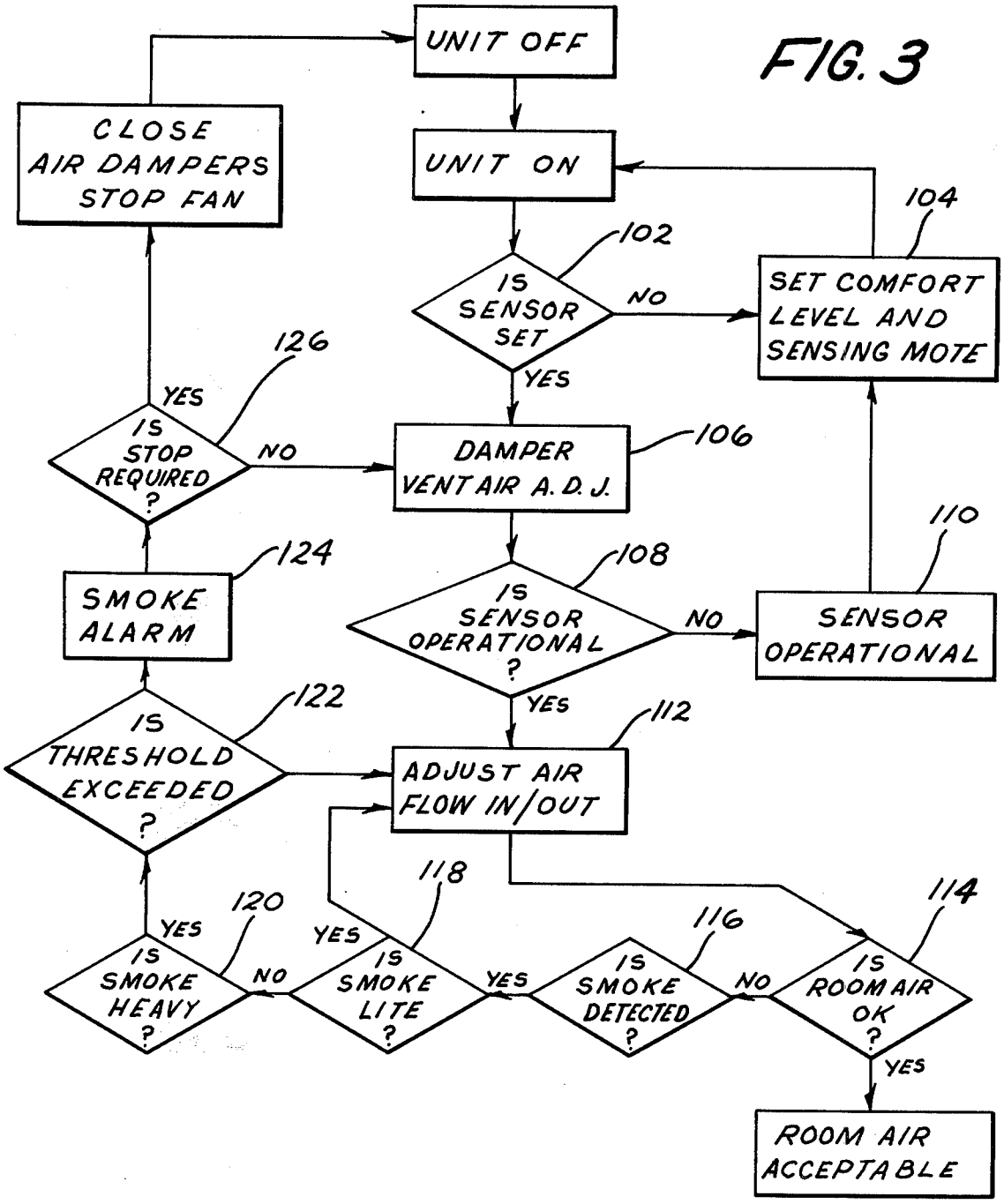
FIG. 3 is a program flow diagram which may be employed in developing a program for the microprocessor of FIG. 2.

Referring now to FIG. 3, a program flow chart is shown which may be used by those skilled in the art to establish a set of program instructions for microprocessor 54. It will be appreciated that the illustrated flow chart may represent only a portion of a complete program for microprocessor 54 by which other functions of the air conditioner may also be controlled.

In initiating operation of the air conditioner, at start up, the temperature control thermostat 26 is set at the comfort level the room is to be maintained, and the smoke or gas impurity level control mode activated through the air sensing function switch 53. Upon activating the gas sensing mode and comfort level, inquiry 102 determines whether they are set. If the answer is no the program moves to instruction 104 to set comfort level and sensing mode. If the answer is yes, then instruction 106 will adjust the damper 40 and fan direction according to the condition of the air sensed by sensor 48. The next inquiry 108 determines whether the sensor 48 is monitoring the gas level. If the answer is no, the program moves to inquiry 110 and asks if the sensor 48 is operational. If not, the program moves to instruction 104. If the answer to inquiry 108 is yes, then instruction 112 will adjust the air flow and damper position relative to the electrical signal generated by the sensor to cause either the venting or exhausting of room air according to the condition of the air sensed. The next inquiry 114 asks if the room air is acceptable. If the answer is yes, then the unit is operational. If the answer is no, inquiry 116 asks if smoke is present. If so, program moves to inquiry 118 and asks if there is light smoke concentration. If yes, program will proceed back to instruction 112 to again adjust air flow. If the answer is no, program moves to inquiry 120 and asks if it is because of heavy smoke concentration. If yes, program proceeds to inquiry 122 and asks if threshold or the corrective capacity of the system has been exceeded. If no, program moves back to instruction 112 to again adjust air flow. If yes, the instruction 124 will energize relay 92 and sound alarm 49 and proceed to next inquiry 126 and ask is stop required. See flow chart. If yes, program will energize relay 98 and turn unit off. If no, the program will proceed to instruction 106 and adjust damper.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

What is claimed is:

1. In a unitary air conditioning unit for conditioning the air in an enclosure including a housing, a partition within said housing dividing said housing into interior and exterior chambers, an outdoor heat exchanger arranged in said exterior chamber adjacent an outlet in said housing, an indoor heat exchanger arranged in said interior chamber, a fan motor arranged in said portion including a fan means in a said exterior chamber for circulating outdoor air through said external chamber, and a fan means in said interior chamber for circulating enclosure air through said chambers; reversing means for electrically changing rotational direction of air flow through said chambers; a vent opening in said partition, a damper including electrically operated means for moving said damper between a closed and open position for allowing an exchange of air between said chambers; an air sensing system in said air conditioning unit comprising:

sensing means located in said housing for sensing the level of humidity and concentration of gases in the air circulating said enclosure, having a first condition for generating electrical signals having values indicative of the level of humidity in said circulating enclosure air contacting said sensing means, and a second condition for generating electrical signals having values indicative of a first level of concentrations of gases in the circulating enclosure air, and a third condition for generating electrical signals having values indicative of a second level of concentration of gases in said circulating enclosure air; and decision means operable in said first condition for causing said electrically operated damper means for moving said damper to an open position and for causing said reversing means to set rotational direction of said fan motor so that said fan means are operable for introducing outdoor air to said interior chamber to be mixed with said enclosure air;

decision means operable in said second condition for causing said reversing means to set rotational direction of said fan motor so that said fan means are operable for exhausting enclosure air into said circulating outdoor air; and decision means operable in said third condition including warning means operable when the level of concentration of gases in the circulating enclosure air is greater than the correction capability of the system;

warning means operative for producing user discernable signal when the level of concentration of gases in the circulating enclosure air increases above a predetermined level.

2. The invention recited in claim 1 further including decision means for causing said damper means to open and energizing said fan reversing means to cause said air flow to exhaust a portion of said circulating enclosure air to said exterior chamber when said sensing means senses a first level of gases in said circulating enclosure air, and for causing said damper means to close and for energizing said warning means when said sensing means senses a second level of gases in said circulating enclosure air.

3. The invention recited in claim 2 wherein said warning means includes an annunciator for issuing an audible signal.

4. The invention recited in claim 3 wherein said warning means further includes a visual indicator.

* * * * *